US005149903A

United States Patent [19]

Iizuka et al.

[11] Patent Number: 5,149,903

[45] Date of Patent: Sep. 22, 1992

[54] MUSICAL TONE GENERATING APPARATUS HAVING MEANS FOR CONTROLLING THE AMPLITUDE OF A MUSICAL TONE SIGNAL ENVELOPE

[75] Inventors: Akira Iizuka; Keiji Kawakami, both of Hamamatsu, Japan

[73] Assignee: Yamaha Corporation, Hamamatsu, Japan

[21] Appl. No.: 671,354

[22] Filed: Mar. 19, 1991

[30] Foreign Application Priority Data

Mar. 19, 1990 [JP] Japan ..... 2-68622

[51] Int. Cl.[5] ..... G10H 1/057

[52] U.S. Cl. ..... 84/627; 84/621; 84/663

[58] Field of Search ..... 84/621, 627, 663, 691, 84/702, 703, 738

[56] References Cited

U.S. PATENT DOCUMENTS 4,928,569 5/1990 Kudo et al. ..... 84/627 X 4,958,552 9/1990 Minamitaka et al. ..... 84/627 X 4,972,754 11/1990 Choi ..... 84/627

*Primary Examiner*—Stanley J. Witkowski

*Attorney, Agent, or Firm*—Spensley Horn Jubas & Lubitz

[57] ABSTRACT

A musical tone generating apparatus includes a waveform generator for generating a musical tone signal corresponding to a desired musical tone based on a key-on event which occurs in a keyboard and an envelope generator for generating an envelope which controls the amplitude of the musical tone signal in response to the key-on event. When a key-on event occurs, the envelope generator compares the current value of the envelope with a predetermined value, and based on the result of this comparison, determines a initial value of the next envelope corresponding to the key-on event. Consequently, the musical tone generating apparatus can generate musical tones without generating a click noise even if the key-on event repeatedly occurs over time at short intervals.

4 Claims, 4 Drawing Sheets

MUSICAL TONE GENERATING APPARATUS HAVING MEANS FOR CONTROLLING THE AMPLITUDE OF A MUSICAL TONE SIGNAL ENVELOPE

BACKGROUND OF THE INVENTION

1. Field of the invention

The present invention relates to musical tone generating apparatuses for electronic musical instruments.

2. Prior Art

In general, electronic musical instruments have a musical tone generating apparatus which generates an amplitude envelope in response to operations applied to a performance operational member, for example a keyboard, and which generates a musical tone signal having an amplitude which is varied over time according to a generated amplitude envelope. FIG. 5 shows a waveform of an envelope generated by a conventional musical tone generating apparatus. In FIG. 5, KON designates a key-on time point at which a key of the keyboard is depressed, and KOF designates a key-off time point, at which the depressed key is released.

During a performance using a keyboard type electronic musical instrument, the same key may be repeatedly depressed within a short interval. In this case, the generation of the envelope corresponding to the second key-on event may be started before the envelope of the musical tone signal corresponding to the first key-on event has sufficiently attenuated. In many conventional musical tone generating apparatuses, when a new key-on event occurs, the envelope corresponding to the new key-on event is started at the predetermined initial value (FIG. 5 shows the case in which that initial value is [−60 dB]). Accordingly, there is a problem in that when plural key-on events repeatedly occur over time, the level of the current envelope suddenly drops to the predetermined initial value as indicated by mark KK in FIG. 5, thereby generating a click noise which is offensive to the ears.

SUMMARY OF THE INVENTION

It is an object of the present invention to provide a musical tone generating apparatus capable of generating musical tones without generating a click noise even if the triggers of musical tone generation repeatedly occur over time at short intervals.

In an aspect of the present invention, there is provided a musical tone generating apparatus comprising:

a triggering means for generating a triggering signal which triggers the generation of the desired musical tone;

a musical tone generating means for generating a musical tone signal corresponding to said desired musical tone based on said triggering signal;

an envelope generating means for generating an envelope which controls the amplitude of said musical tone signal in response to said triggering signal, whereby when said triggering signal is generated, said envelope generating means compares the current value of said envelope with a predetermined value, and based on the result of this comparison, determines an initial value of the next envelope corresponding to said triggering signal.

The other objects and features of this invention will be understood from the following description with reference to the accompanying drawings.

DESCRIPTION OF PREFERRED EMBODIMENTS

Figure 1:
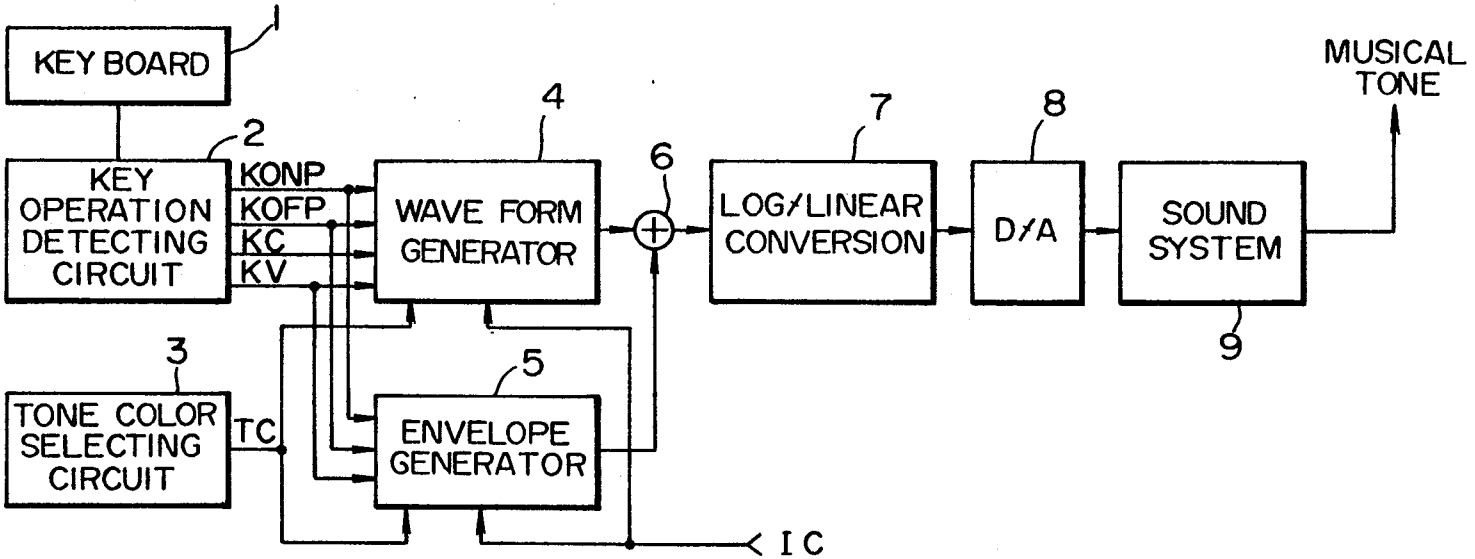
FIG. 1 is a block diagram showing a configuration of an electronic musical instrument having a musical tone generating apparatus according to a preferred embodiment of the present invention.

In FIG. 1, a block diagram showing the functional layout of an electronic musical instrument which has a musical tone generating apparatus of a preferred embodiment of the present invention is presented. In this drawing, reference numeral 1 designates a keyboard which is operated by a performer. Reference numeral 2 designates a key operation detecting circuit which detects operations applied to keys of the keyboard 1, and which generates plural control data in response to these detected operations. More specifically, when any key of keyboard 1 is depressed, a key-code KC corresponding to the depressed key, velocity data KV designating the velocity at which the key is depressed, and key-on pulse KONP indicating that the key is depressed are provided by key operation detecting circuit 2, whereas when the depressed key is released, a key-off pulse KOFP is provided by key operation detecting circuit 2. Reference numeral 3 designates a tone color selecting circuit which detects operations applied to the tone color switches (not shown) provided on the control panel of this electronic musical instrument, and generates tone color data TC corresponding to the detected operation.

Reference numeral 4 designates a waveform generator which generates waveforms based on the tone color data TC, the velocity data KV and the key-code data KC. Hereinafter, the waveform generated by the waveform generator 4 will be called the basic waveform. The waveform generator 4 sequentially outputs a series of basic waveform data logMs, wherein each basic waveform data logM indicates a logarithmic value of the current amplitude of basic waveform. The generation of the basic waveform is triggered by key-on pulse KONP. Reference numeral 5 designates an envelope generator. This envelope generator 5 generates envelope waveforms based on key-on pulse KONP, key-off pulse KOFP, velocity data KV and tone color data TC. More specifically, the envelope generator 5 generates a series of envelope data logENVs, wherein each envelope data logENV indicates a logarithmic value of the current amplitude envelope waveform. The envelope generator 5 and above-described waveform generator 4 are initialized by an initialize signal IC supplied by a control circuit (not shown) when electric power is supplied to this electronic musical instrument.

Reference numeral 6 designates an adder which adds basic waveform data logM and envelope data logENV. The adder 6 outputs the amplitude data of the waveform which is modulated by the envelope waveform, wherein the amplitude data indicate logarithmic values of the musical tone signal to be generated. Reference numeral 7 designates a logarithm/linear converter which converts the amplitude data defined as logarithmic values to linear amplitude data which indicate the current amplitude of musical tone signal. Reference numeral 8 designates a D/A (Digital/Analog) converter which converts the digital amplitude data output from the logarithm/linear converter 7 to an analog signal. The analog signal output from D/A converter 7 is supplied to a sound system 9, resulting in a musical tone.

Figure 2:
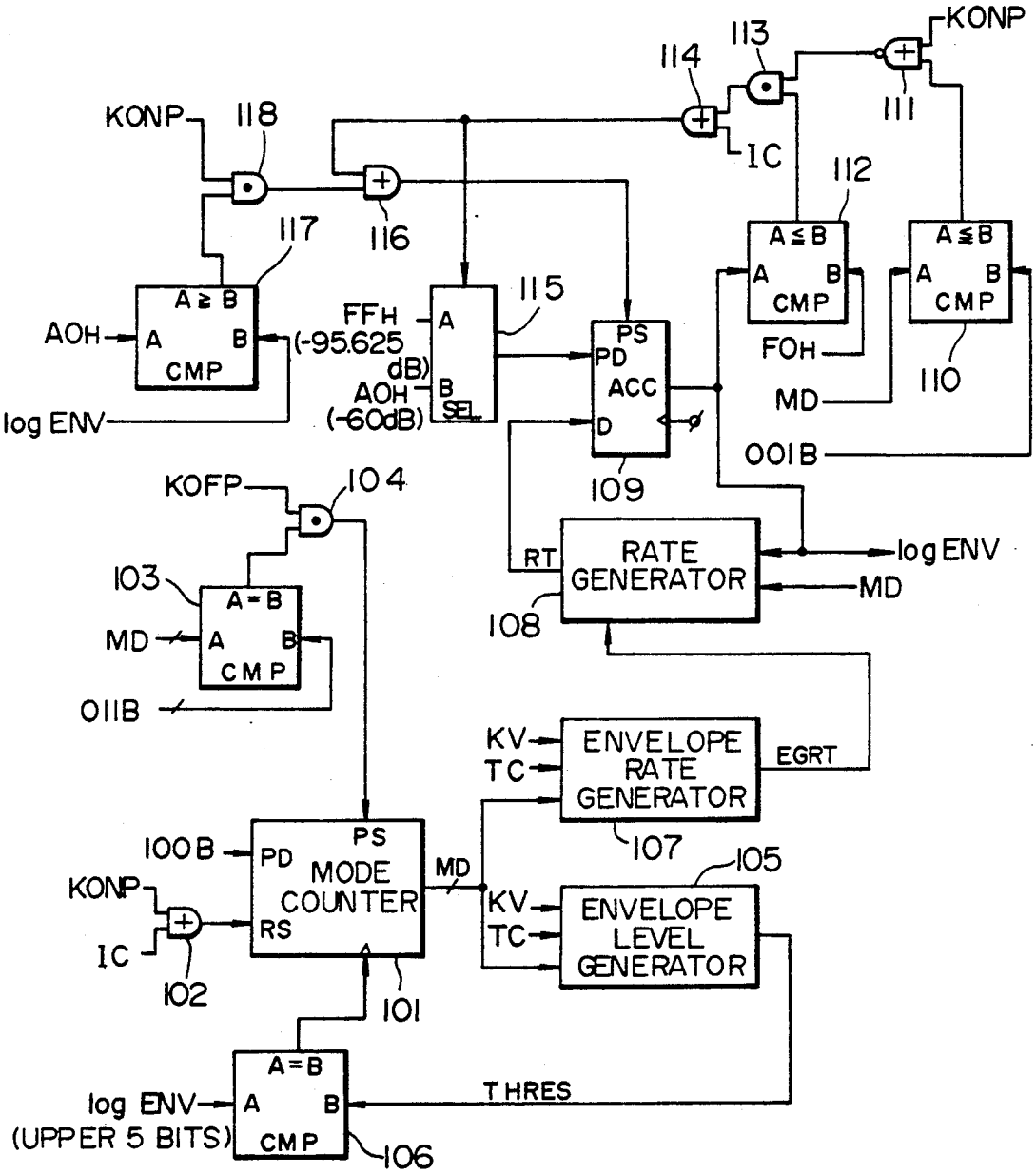
FIG. 2 is a block diagram showing a configuration of an envelope generator used in the electronic musical instrument shown in FIG. 1.
Figure 3:
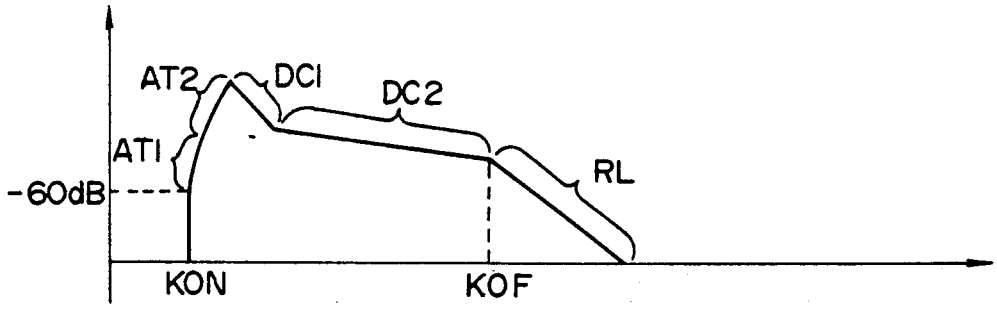
FIGS. 3(*a*) to 3(*c*) are waveform charts showing operations of the envelope generator shown in FIG. 2.
Figure 3:
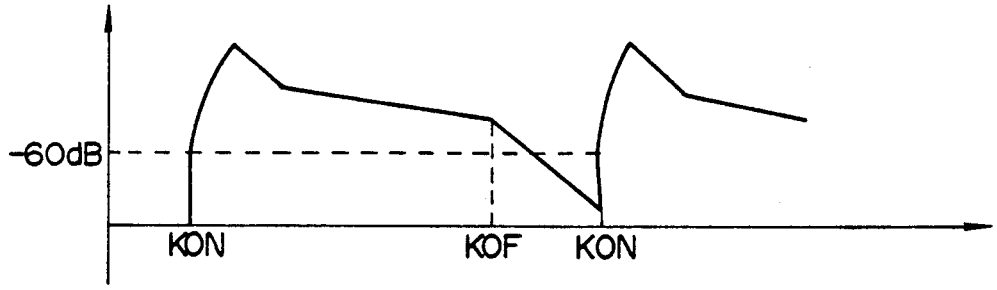
Figure 3:
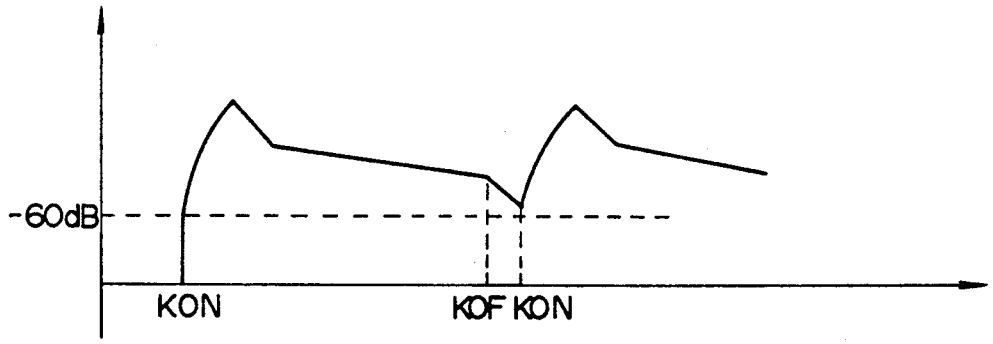
Figure 5:
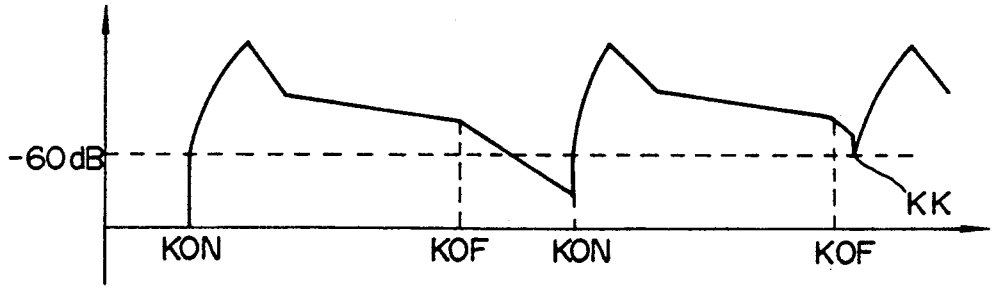
FIG. 5 is a waveform chart showing an amplitude envelope waveform generated by a conventional musical tone generating apparatus.

FIG. 2 shows a circuit diagram showing an electronic configuration of the envelope generator 5. FIGS. 3(*a*) through 3(*c*) are waveform charts showing examples of envelope waveforms generated by the envelope generator 5. In FIG. 2, 101 designates a mode counter which outputs a mode data MD. The mode data MD indicates the section of waveform to be generated. The amplitude envelope of a generated musical tone has 5 sections, i.e., the first attack section AT1, the second attack section AT2, the first decay section DC1, the second decay section DC2 and the release section RL. In each section, the amplitude of the musical tone signal is varied by a respective control method different from the method applied in the other sections. Thus, in the envelope generator 5, the generation of envelope data logENV is controlled according to the current mode data MD, and generated envelope data logENV is observed and judged as to whether it exceeds the current section. When the envelope data logENV exceeds the current section, the mode data MD is updated and a new control method corresponding to the new section is applied. The contents of mode data MD respectively correspond to the sections of envelope as following table-1.

TABLE 1

| Mode data MD and the sections of the envelope | |
|---|---|
| MD | Sections |
| 000B | The first attack section AT1 |
| 001B | The second attack section AT2 |
| 010B | The first decay section DC1 |
| 011B | The second decay section DC2 |
| 100B | The release section RL |

The key-on pulse KONP and initialize signal IC are supplied to the reset input terminal RS of mode counter 101. In addition, a fixed data [100B] (herein, B indicates binary) is supplied to the preset data input terminal PD of mode counter 101. 103 designates a comparison circuit which compares the mode data MD with a fixed data [011B]. In the case where MD=[110B], the data "1" is provided by the output terminal A=B of comparison circuit 103. The data provided by the output terminal A=B of comparison circuit 103 and the key-off pulse KOFP are supplied to an AND gate 104. The output data of AND gate 104 is supplied to the preset input terminal PS of mode counter 101.

Reference numeral 105 designates an envelope level generator which generates a reference level data THRES based on the mode data MD, tone color data TC and velocity data LV, wherein current reference level data THRES is used for judging whether the waveform generation mode can be changed to the next mode. A comparison circuit 106 compares the upper 5 digits of envelope data logENV with the reference level data THRES. When the data defined by the upper 5 digits of envelope data logENV is coincident with the current reference level data THRES, a data "1" is provided from the output terminal A=B of comparison circuit 106. Here, the envelope data logENV is supplied from an accumulator 109 (described later on), and consists of 8-bit data. Each bit of data of envelope data logENV indicates an attenuation gain as shown in table-2.

TABLE 2

| Attenuation gains of 8-bit data of logENV | |
|---|---|
| Bit No. 8 (MSB) | −48dB |
| Bit No. 7 | −24dB |
| Bit No. 6 | −12dB |
| Bit No. 5 | −6dB |
| Bit No. 4 | −3dB |
| Bit No. 3 | −1.5dB |
| Bit No. 2 | −0.75dB |
| Bit No. 1 (LSB) | −0.375dB |

The data provided by the output terminal A=B of comparison circuit 106 is supplied to the clock input terminal of mode counter 101. Accordingly, every time the upper 5-bit data of envelope data logENV is coincident with the current reference level data THRES, the input signal supplied to the clock input terminal of mode counter 101 is raised, whereby the mode data MD is incremented by one and new reference level data corresponding to the incremented mode data MD is generated by the envelope level generator 105.

The envelope rate generator 107 generates an envelope rate data EGRT based on the mode data MD, tone color data TC and velocity data KV, wherein the envelope rate data designates the variation ratio of the envelope data logENV. A rate generator 108 generates a differential data RT based on the envelope data logENV, mode data MD and envelope rate data EGRT, wherein the differential data RT determines the differential value of envelope data logENV. The differential data RT is supplied to the data input terminal D of accumulator 109. When the value of the preset input terminal PS of accumulator 109 is "0", the differential data RT is entered into the accumulator 109 via the data input terminal D in synchronization with clock $\phi$, which has a predetermined constant period, and is summed with the envelope data logENV currently stored in the accumulator 109, after which the result of the summation is stored in the accumulator 109 as updated envelope data logENV. When the value of the preset input terminal PS of accumulator 109 is "1", the input data of the preset data input terminal PD is written in accumulator 109 in synchronization with clock $\phi$.

Figure 4:
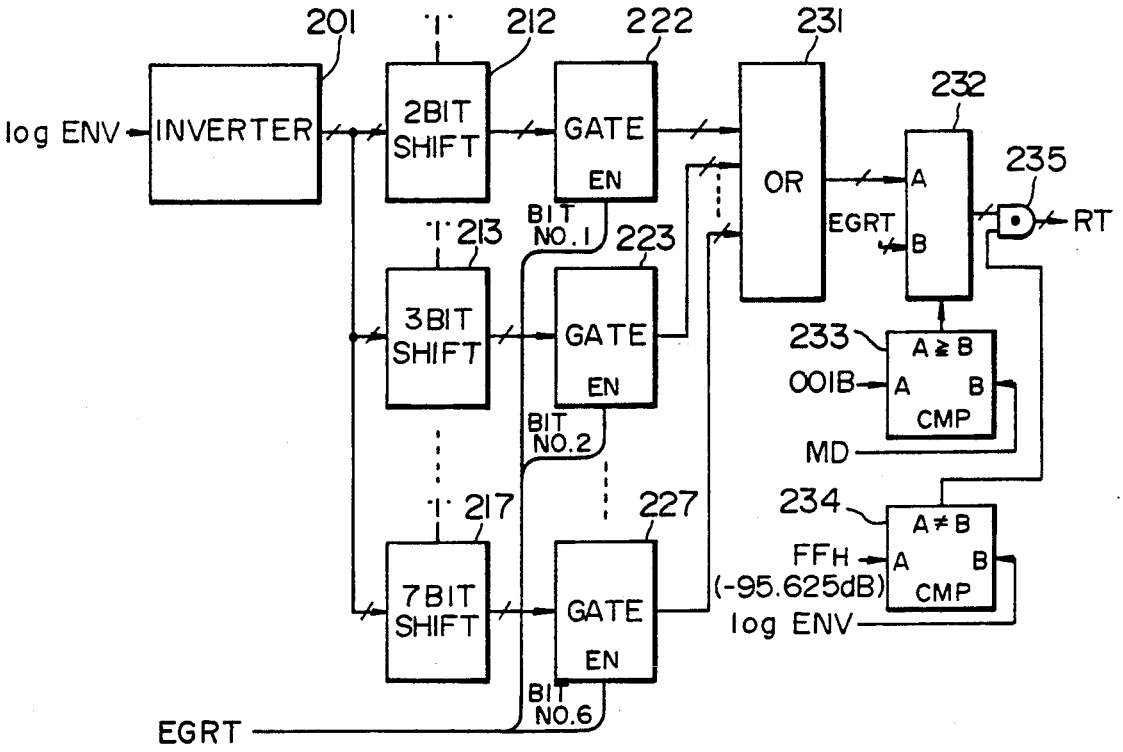
FIG. 4 is a block diagram showing a configuration of an envelope rate generator used in the envelope generator shown in FIG. 2.

Next, the configuration of rate generator 108 will be described with reference to FIG. 4. The envelope data logENV is supplied to an inverter 201, whereby the inverter outputs an 8-bit data obtained by inverting the respective bits of logENV. Shift circuits 212 through 217 are supplied with the same output data of inverter 201. In each one of the shift circuits 212 through 217, bit shift operation from MSB toward LSB is carried out by supplementing the desired number of data "1" to MSB, whereby shift circuits 212 through 217 respectively output data which is 2-bit through 7-bit shifted from the same output data of inverter 201.

The output data of shift circuits 212 through 217 are respectively supplied to gate circuits 222 through 227. These gate circuits are respectively supplied with bit No. 1 through bit No. 6 of envelope rate data EGRT, wherein each bit of EGRT is used for enabling data, which controls the output function of the corresponding gate circuit. Thus, each one of the shift circuits 212 through 217 is supplied to an OR gate 231 via a corresponding gate circuit 222 through 227 when the output function thereof is enabled.

The comparison circuit 233 compares the mode data MD with a fixed data [001B], whereby when MD is less than or equal to [001B], the value of output terminal A≧B becomes "1". The output data provided by output terminal A≧B of comparison circuit 233 is supplied to a selector 232 as the select control data. When this select control data is "1", the output data of OR gate 231 is selected by selector 232, whereas when this select control data is "0", the envelope rate data EGRT is selected. The data selected by selector 231 is supplied to an AND gate 235. A comparison circuit 234 compares the envelope data logENV with a fixed data [FFH] which corresponds to an attenuation gain [−95.625 dB]. When logENV=[FFH], the value of output terminal A≠B becomes "0", whereby data in which all bits are "0" is provided by the AND gate 235 as the differential data RT. In contrast, when logENV≠[FFH], the output data of selector 232 is provided via AND gate 235 as the differential data RT.

Differential data RT is generated by this rate generator 108 and supplied to the accumulator 109 as follows:

(1) logENV=[FFH](−95.625dB)

In this case, the data in which all bits are "0" is obtained as the differential data RT independently of EGRT.

(2) logENV≠[FFH] and MD≦[001B], i.e., in the case of the first and second attack sections.

The differential data RT is calculated based on the envelope rate data EGRT and the output data of OR gate 231, i.e., the data in which all bits are inverted from logENV. In this case, MSB becomes "1". Accordingly, when the accumulation operation of logENV by using data RT is carried out by accumulator 109, an overflow occurs in that accumulation operation, whereby the absolute value of the attenuation gain of logENV becomes smaller (i.e., the envelope is raised). In addition, when the difference between logENV and [FFH] becomes larger, the data in which all bits are inverted from logENV becomes larger, whereby the value of the differential data RT becomes larger. For this reason, the gradient of logENV becomes milder as the difference between logENV and [FFH] becomes larger. In this way, the series of logENV corresponding to the first and second attack sections of envelope waveform is generated. Additionally, in this case, the magnitude of the differential data RT is controlled by envelope rate data EGRT, whereby the gradient of the attack sections of envelope waveform is controlled.

(3) logENV≠[FFH] and MD>[001B], i.e., in the case of sections after the first decay section.

In this case, the envelope rate data EGRT is provided as the differential data RT. Accordingly, the envelope data logENV held by accumulator 109 increases in a linear manner over time.

A comparison circuit 110 compares the mode data MD with a fixed data [001B]. When the mode data MD is less than or equal to [001B], the value of output terminal A≦B becomes "1". The output data of comparison circuit 110 and the key-on pulse KONP are supplied to a NOR gate 111. A comparison circuit 112 compares the envelope data logENV with a fixed data [FOH] corresponding to [−90 dB]. When logENV≦[FOH], the value of the output terminal A≦B of comparison circuit 112 becomes "1". The output data of comparison circuit 112 and the output data of NOR gate 111 are supplied to an AND gate 113. The output data of AND gate 113 and the initialize signal IC are supplied to a OR gate 114. The output data of OR gate 114 is supplied to on selector 115 as the select control data, and also supplied to the preset input terminal PS of accumulator 109 via an OR gate 116. A fixed data [FFH] corresponding to [−95.625 dB] is supplied to the input terminal A of selector 115, and a fixed data [AOH] corresponding to [−60 dB] is supplied to the input terminal B of selector 115. When the select control data supplied by OR gate 114 is "0", the data [FFH] is selected by selector 115, whereas when the select control data is "1", the data [AOH] is selected. Then, the selected data is supplied to the accumulator 109. A comparison circuit 117 compares the envelope data logENV with a fixed data [AOH] corresponding to [−60 dB]. When logENV≦[AOH], the value of output terminal A≧B becomes "1", whereby an AND gate 118 is enabled. In this case, when the key-on pulse KONP occurs, the key-on pulse KONP is supplied to the preset terminal PS of accumulator 109 via the AND gate 118 and OR gate 116.

Thereafter, the operation of this electronic musical instrument will be described. When the power supply of this electronic musical instrument is turned on, and the electric power is supplied to the respective portions of this electronic musical instrument, the predetermined initialize operation is carried out by the control circuit. In this initialize operation, the value of initialize signal IC is held at "1" by the control circuit, whereby the waveform generator 4 is initialized. Additionally, in the envelope generator 5, the output data of OR gate 102 becomes "1", whereby the mode counter 101 is reset, so that the mode data MD is initialized to [000B]. Further, both the output data of OR gates 114 and 116 becomes "1", whereby the fixed data [FFH] (−95.625 dB) is supplied to the accumulator 109 via selector 115 and this fixed data is written in accumulator 109 as the initial value of logENV. Additionally, by this initialization, both the value of output terminal A≦B of comparison circuit 110 and the value of output terminal A≦B of comparison circuit 112 become "1", the value of output terminal A≧B of comparison circuit 117 becomes "1", and the value of output terminal A=B of comparison circuit 103 becomes "0". Further, because of logENV=[FFH], the data in which all bits are "0" is provided from the rate generator 108 as the differential data RT. Accordingly, the value of envelope data logENV maintains constant data [FFH]. After the predetermined time elapses, the intialize signal IC returns to level "0", whereby the selector 115 selects the fixed data [FFH].

When any key of the keyboard is depressed by a performer, the key-code KC corresponding to the depressed key, the velocity data KV designating the velocity of the depressed key, and the key-on pulse KONP are generated by key operation detecting circuit 2. As a result, the basic waveform of the musical tone which has a tone color designated by tone color data TC supplied from tone color selecting circuit 3 and a tone pitch corresponding to the key-code KC is generated by the waveform generator 4, and a series of the waveform data logM is sequentially provided by the waveform generator 4.

On the other hand, in envelope generator 5, the key-on pulse KONP is supplied to the preset terminal PS of accumulator 109 via AND gate 118 and OR gate 116. As a result, the fixed data [AOH] (−60 dB) which is currently supplied to the preset data terminal PD of accumulator 109 via selector 115 is written in accumulator 109 as the envelope data logENV.

In the rate generator 108, the differential data RT are sequentially generated based on the envelope data logENV and envelope rate data EGRT as above described, because logENV≠[FFH]. The differential data RT generated by the rate generator 108 are sequentially accumulated in accumulator 109. Consequently, the envelope data logENV is raised with a mild curve (the first attack section ATK1).

When the value of the upper 5 bits of envelope data logENV reaches the reference level data THRES, the output of comparison circuit 106 begins, whereby the mode data MD is changed to [001B]. Thus, the reference level data THRES corresponding to MD=[001B] is generated by envelope level generator 105, whereby the output of comparison circuit 106 ends. Additionally, the envelope rate data EGRT corresponding to MD=[001B] is generated by the envelope rate generator 107. As a result, the differential data RT is generated based on the new envelope rate data EGRT, and the envelope data logENV is raised based on new envelope rate data RT (the second attack section ATK2).

Thereafter, as described above, every time the envelope data logENV reaches the current reference level data THRES corresponding to the current mode data MD, the envelope rate data EGRT is changed, whereby the generation method for envelope data logENV is changed. When the value of mode data MD is changed to [001B], the value of output terminal A=B of comparison circuit 103 becomes "1", whereby AND gate 104 is enabled. Thereafter, when the depressed key of the keyboard is released, the key-off pulse KOFP is supplied to mode counter 101, whereby the value of mode data MD is set to [100B]. Then, the envelope rate data EGRT corresponding to MD=[100B] is generated, whereby a series of envelope data logENV corresponding to the release section RL is sequentially generated.

The envelope data logENVs generated as above described are sequentially added to the current basic waveform data logM, after which the results are sequentially converted to linear data by D/A converter 8 and supplied to sound system 9, whereby a musical tone is obtained.

Hereinafter, the operation in the case where a key is depressed while a musical tone is being generated will be described. First described is a case in which the value of envelope data logENV is less than or equal to [−60 dB] when the key-on pulse KONP occurs. In this case, the value of output terminal A≧B is "1", so that the fixed data AOH (−60 dB) is set into accumulator 109 as envelope data logENV when the key-on pulse is raised to "1". Then, the mode counter 101 is reset by key-on pulse KONP, so that MD=[000B]. Thereafter, the envelope data logENV is generated by the same method as above described. In this manner, a series of envelope data logENV having an initial value of logENV=[−60 dB] corresponding to the second key-on is generated as shown in FIG. 3(*b*).

Next described is a case in which the value of envelope data, logENV exceeds [−60 dB] when the key-on pulse corresponding to the second key-on occurs. In this case, the value of output terminal A≧B of comparison circuit 117 is "0", so that the preset operation of accumulator 109 is not carried out even if the key-on pulse KONP occurs, rather, only the reset operation of mode counter 101 is carried out. Consequently, as shown in FIG. 3(*c*), a series of envelope data logENV corresponding to the second key-on and having on initial value which is the same as the last value of the envelope data logENV generated in response to the first key-on is generated.

When the second key-on is not carried out after the first key-on is carried out, the generation of envelope data logENV proceeds to the operation corresponding to MD>[001B], i.e., the operation for the first decay section DC1, the second decay section DC2 or the release section RL. When the mode data MD exceeds [001B] and the value of logENV is less than or equal to [−90 dB], the following operation is carried out. In this case, the value of output terminal A≦B of comparison circuit 110 is "0" and the value of key-on pulse KONP is "0", so that the output value of NOR gate 111 becomes "0". Additionally, the value of output terminal A≦B is "1", so that the output value of OR gate 114 is "1", whereby the fixed data [FFH] (−95.625 dB) is selected by selector 115 and written in accumulator 109.

In the above described preferred embodiment, a case was described in which the electronic musical instrument has only one sound channel for generating musical tones. However, the present invention can be applied to electronic musical instruments which have plural sound channels. In this kind of electronic musical instrument, a number of musical tones can be generated by using respective sound channels. However, in the case where musical tones which have the same key-code are repeatedly generated at short intervals, the repeated musical tones are generated by using the same sound channel. The present invention can be applied to the control of the envelope in this case. Additionally, in the above described embodiment, the envelope data logENV is obtained by calculation. However, the envelope data logENV can also be obtained by reading out a series of envelope data logENV which have been previously stored in a memory.

What is claimed is:

1. A musical tone generating apparatus comprising:

triggering means for generating a triggering signal which triggers the generation of a desired musical tone;

musical tone generating means for generating a musical tone signal corresponding to said desired musical tone based on said triggering signal, said musical tone signal having an amplitude;

envelope generating means for generating an envelope which controls the amplitude of said musical tone signal, said envelope having current values measurable according to the amplitude of said musical tone signal; and control means for controlling an initial value of a next envelope based on a comparison result obtained through a comparison operation in which the current value of said envelope generated in response to the previously generated triggering signal is compared with a predetermined value when said triggering signal is generated.

2. A musical tone generating apparatus according to claim 1, wherein when the current value of said envelope is less than or equal to said predetermined value, said control means determines said initial value so as to be equal to said predetermined value, whereas when the current value of said envelope is greater than said predetermined value, said control means determines said initial value so as to be equal to said current value of said envelope.

3. A musical tone generating apparatus according to claim 1 further comprising:

an adder means; and a log/linear conversion means, wherein data corresponding to said musical tone signal is represented logarithmically, and data corresponding to said envelope is represented logarithmically, and further wherein said adder means adds said musical tone signal to said envelope, and said log/linear conversion means converts the result of this addition to a linear form corresponding to the desired musical tone.

4. A musical tone generating apparatus according to claim 1, further comprising a memory means for storing the current value of the envelope generated by the envelope generating means, wherein said envelope generating means presets said initial value in said memory means when said triggering signal is generated.

* * * * *